US005675352A

United States Patent [19]

Rich et al.

[11] Patent Number: 5,675,352

[45] Date of Patent: Oct. 7, 1997

[54] LIQUID CRYSTAL DISPLAY DRIVER

[75] Inventors: David Arthur Rich, Whitehall; Harold Joseph Wilson, Green Lane, both of Pa.

[73] Assignee: Lucent Technologies Inc., Murray Hill, N.J.

[21] Appl. No.: 526,026

[22] Filed: Sep. 7, 1995

[51] Int. Cl.[6] ..... G09G 3/00

[52] U.S. Cl. ..... 345/89; 345/52

[58] Field of Search ..... 345/52, 89

[56] References Cited

U.S. PATENT DOCUMENTS 4,356,483 10/1982 Fujita et al. ..... 345/52
5,061,920 10/1991 Nelson ..... 345/89

OTHER PUBLICATIONS

Multiplexing Liquid–Crystal Displays By: Paul Smith May 25, 1978.

*Primary Examiner*—Richard Hjerpe
*Assistant Examiner*—Ricardo Osorio

[57] ABSTRACT

In accordance with one aspect of the invention, a liquid crystal display driver for driving liquid crystal display electrodes, comprises: a voltage signal generator adapted to provide a predetermined voltage signal to the liquid crystal display electrodes, the voltage signal generator being further adapted to be activated when the voltage signal level of said electrodes is outside a predetermined dead zone region, the voltage signal generator being deactivated when the voltage signal level of the electrodes is substantially within the predetermined dead zone region; and a switch adapted to couple the voltage signal generator to at least one of said liquid crystal display electrodes. In accordance with another aspect of the invention, a method for providing voltage signals to electrodes of a liquid crystal display, comprising the steps of activating a first voltage signal generator to provide a voltage signal for the electrodes when the voltage signal level of the ectrodes falls outside a dead zone region; and deactivating the first voltage signal generator when the voltage signal level of the electrodes falls within the dead zone region.

21 Claims, 6 Drawing Sheets

LIQUID CRYSTAL DISPLAY DRIVER

TECHNICAL FIELD

The present invention relates to Liquid Crystal Displays (LCD) and, more particularly, to LCD drivers.

BACKGROUND OF THE INVENTION

Liquid Crystal Displays (LCDs) are used in many applications where it is desired to display information on a display panel. FIG. 2 illustrates a conventional liquid crystal display 10. Basically, a sandwich of liquid crystals 16 lies between a front electrode panel 26 and a backplane electrode panel 18. Front electrode panel 26 may include several numerical or alphanumerical digits and characters that are formed by individual light-transparent units known as segment electrodes. For example, a numerical digit may be formed of seven segment electrodes 14. Depending on the number desired to be displayed, one or more of the segment electrodes may appear dark. The liquid crystal display further includes a front vertical light filter 12 and a rear horizontal light filter 22. The front vertical filter receives external light, which is randomly polarized, and passes the light rays that are substantially vertically polarized. Likewise, the rear horizontal filter is configured to pass light rays that are substantially horizontally polarized.

Behind horizontal filter 22 lies a mirror 24 that reflects the light passing through the horizontal filter. The operation of liquid crystal displays is well-known and described in, Electronics, *Multiplexing Liquid Crystal Displays*, by Paul Smith (May 25, 1978), incorporated herein by reference.

A liquid crystal display operates based on the effect of liquid crystals on the light rays that pass through them. Liquid crystals are liquid materials with molecules arranged in patterns similar to those of other crystals found in nature, or synthetically made. The molecules are normally twisted along a longitudinal axis. When polarized light passes through the liquid crystals, its plane twists through a right angle. Thus, a vertically polarized light ray emerges from a liquid crystal region as a horizontally polarized light ray. An electric field with an amplitude over a certain threshold changes the pattern of molecules in liquid crystals, and aligns them along a straight plane. This electric field causes the molecules to line up so that polarized light is no longer affected when it passes through the crystals.

During operation, randomly polarized light strikes on vertical filter 12 and a vertically polarized light ray 30 emerges from the vertical filter. Light ray 30 then passes through transparent segment electrodes 14. The segment electrode through which light ray 30 passes, is biased by an electric filed having an amplitude larger than the threshold level necessary to change the pattern of liquid crystal molecules. Thus, light ray 30 passes through liquid crystals unchanged, and travels to rear horizontal filter 22. Because light ray 30 remains vertically polarized, the horizontal filter blocks its passage. As a result, the segment electrode through which light ray 30 traveled appears to be dark. Likewise, a vertically polarized light ray 32 emerges from vertical filter 12. Light ray 32 then passes through transparent segment electrodes 14. The segment electrode through which light ray 32 passes is biased by an electric field having an amplitude smaller than the threshold level necessary to change the pattern of liquid crystal molecules. Thus, the liquid crystal polarizes light ray 32 along a horizontal plane. The horizontally polarized light ray 32 travels to rear horizontal filter 22. The horizontal filter permits the passage of light ray 32. As a result, light ray 32 strikes on mirror 24 and reflects back through horizontal filter 22 to the segment through which it originally passed. Thus, this segment appears to be light.

Segment electrode 14 and backplane electrode 20 are typically driven by liquid crystal display drivers, such as voltage regulators that provide appropriate voltage or current signals to terminals 34 and 36. The segment electrodes and backplane electrodes provide effective capacitive loads that are charged to a certain desired voltage level. In operation, it is desired to provide an alternating current (AC) signal to these electrodes rather than a direct current (DC) signal to generate an AC electric field across the liquid crystals. Otherwise, the operation of liquid crystals, as previously described, substantially deteriorates if it is biased by a direct current (DC) signal. Thus, a sufficiently high amplitude AC signal is applied to the electrodes when it is desired to affect the orientation of liquid crystal molecules, and a low amplitude AC signal is applied when it is desired to maintain the twisted orientation of liquid crystal molecules.

During operation, the voltage regulators that drive the electrodes, effectively drive a number of capacitive loads at the same time. Because the regulators provide an AC signal to these capacitive loads, it is desirable that little or no oscillation occurs during their operation. At least one disadvantage associated with conventional regulators is an implementation employing complex analog circuit processing to maintain stable operation. Another disadvantage associated with conventional regulators is significant power utilization to provide the AC signal described above. This is undesirable, particularly when the liquid crystal display is being operated with a limited energy source, such as, for example, battery driven LCDs.

Hence, there is a need for a liquid crystal display driver that reduces the foregoing problems.

SUMMARY OF THE INVENTION

Briefly, in accordance with one aspect of the invention, a liquid crystal display driver for driving liquid crystal display electrodes, comprises: a voltage signal generator adapted to provide a predetermined voltage signal to the liquid crystal display electrodes, the voltage signal generator being further adapted to be activated when the voltage signal level of said electrodes is outside a predetermined dead zone region, the voltage signal generator being deactivated when the voltage signal level of the electrodes is substantially within the predetermined dead zone region; and a switch adapted to couple the voltage signal generator to at least one of said liquid crystal display electrodes.

Briefly, in accordance with another aspect of the invention, a method for providing voltage signals to electrodes of a liquid crystal display, comprising the steps of activating a first voltage signal generator to provide a voltage signal for the electrodes when the voltage signal level of the electrodes falls outside a dead zone region; and deactivating the first voltage signal generator when the voltage signal level of the electrodes falls within the dead zone region.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION OF THE INVENTION

Figure 3:
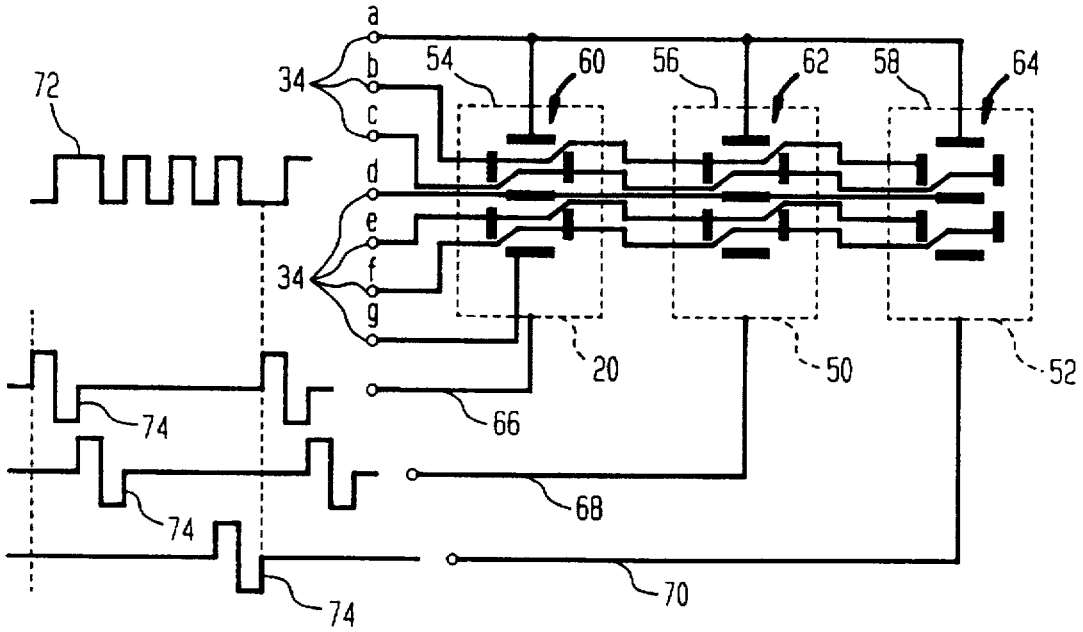
FIG. 3 is a schematic diagram illustrating a wiring layout for providing voltage or current signals to segment electrodes and backplane electrodes in a liquid crystal display. Such a wiring layout may be used in conjunction with an embodiment of a liquid crystal display driver in accordance with the invention.
Figure 2:
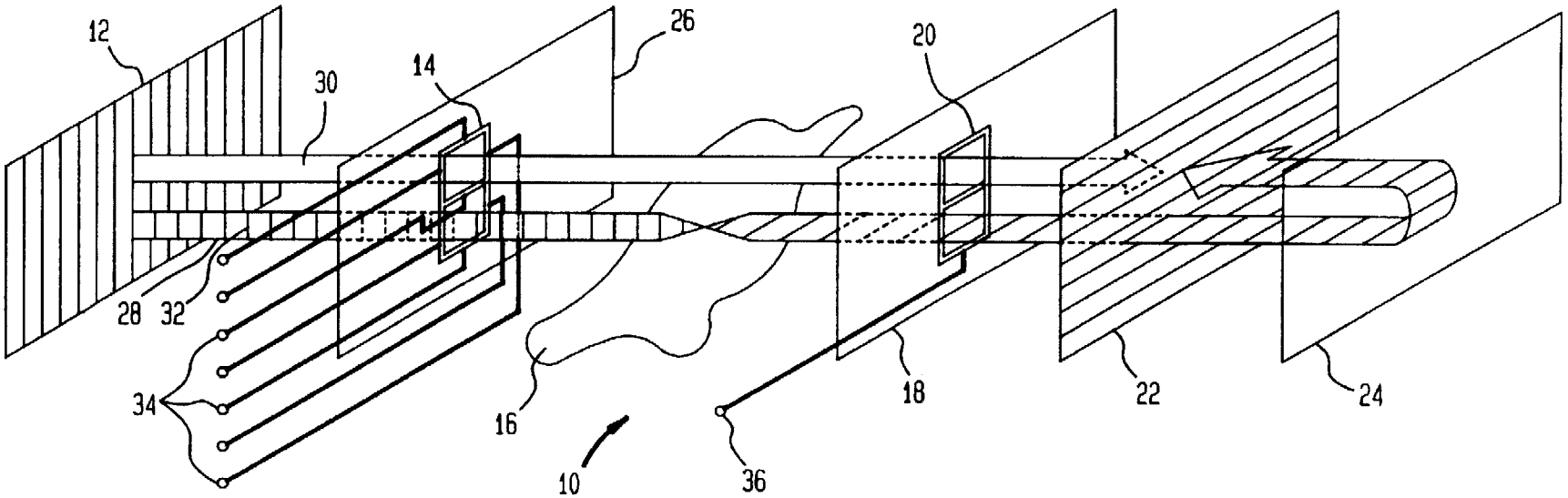
FIG. 2 is an exploded illustration of some elements that form a liquid crystal display (LCD).

FIG. 3 illustrates an example of a wiring arrangement for applying voltage or current signals to segment and backplane electrodes of a liquid crystal display, such as LCD 10 illustrated in FIG. 2, although the invention is not limited in scope to this particular wiring arrangement. This arrangement has been described in the previously cited reference, Electronics, *Multiplexing Liquid Crystal Displays*, by Paul Smith (May 25, 1978), and incorporated herein by reference. A predetermined number of numerical digits, such as 60, 62, and 64 with corresponding backplane electrodes, such as 20, 50 and 52, respectively, are coupled together so as to receive multiplexed signals, as will be explained in more detail hereinafter. Each numerical digit is formed of seven segment electrodes. For one particular arrangement, groups of four numerical digits are coupled together (not shown). However, the invention is not limited in scope to groups of four numerical digits and up to n numerical digits may be coupled together, where n is a positive integer.

Each segment electrode of a numerical digit is coupled to corresponding segment electrodes of the remaining digits. For example, segment electrode 54 of numerical digit 60 is coupled to segment electrode 56 of numerical digit 62, to segment electrode 56 of numerical digit 64 and so forth. Thus, the segment electrodes of each group of four numerical digits share seven terminals 34*a* to 34*g* to receive electrical signals intended to control the orientation of liquid crystal molecules disposed between the segment electrodes and the backplane electrodes. Each backplane electrode, such as 20, 50 and 52, receives an electrical signal via signal lines 66, 68 and 70, respectively. The electrical signals are applied to the backplane electrodes to control the orientation of liquid crystal molecules disposed between the segment electrodes and the backplane electrodes.

Figure 4:
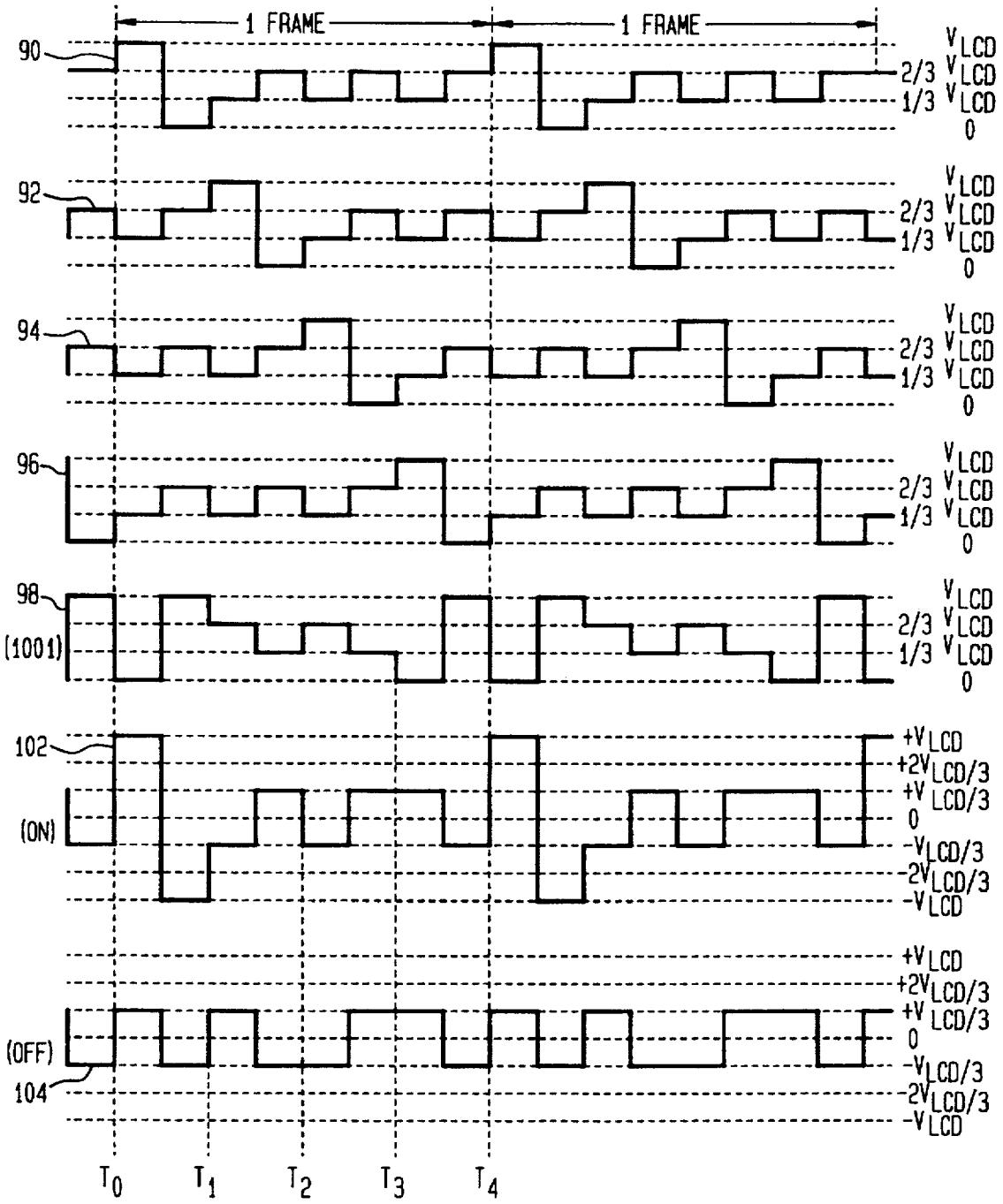
FIG. 4 is a timing diagram illustrating signal levels applied to the segment electrodes and backplane electrodes of FIG. 3.

As mentioned previously, in order to increase the life of the liquid crystal display, it is desirable to apply a time varying (AC) voltage or current signal to both segment electrodes and backplane electrodes. Thus, a nominal AC voltage signal 70 is continually applied to terminals 34 corresponding to front segment electrodes of liquid crystal display. Likewise, a nominal AC signal, as illustrated in FIG. 4, is applied substantially simultaneously to signal lines, such as 66, 68 and 70. It will be appreciated that the amplitude of these nominal AC signals is small enough to not affect the orientation of liquid crystal molecules, and is large enough to prevent the crystals from deteriorating in a substantially short period of time.

In the group of numerical digits coupled together, the backplane electrodes sequentially receive a multiplexed biasing signal 74 having an amplitude larger than the nominal AC signals mentioned above. If at substantially the same time that a backplane of a numerical digit is biased with a biasing signal 74, the corresponding segment electrode in front of the backplane also receives a biasing signal above a predetermined threshold, the liquid crystals lying in between these electrodes become affected and change their orientation.

FIG. 4 illustrates an example of a timing diagram for signals that may bias the segment and backplane electrodes illustrated in FIG. 3, although the present invention is not limited in scope to such a timing arrangement. An example of a liquid crystal display driver generating such a timing diagram may be a Motorola display driver, model no. MC68HC05L5, described in its specification, incorporated herein by reference.

The electrodes associated with a group of four numerical digits may be sequentially biased above a nominal alternating current (AC) voltage signal within a frame period. Thus, within a frame period, a biasing signal 74 is sequentially coupled to all of the backplane electrodes within a group of four numerical digits, such that each back plane electrode is biased at a specified time slot within the frame period. The biasing signal applied to backplane electrodes repeat again within subsequent frame periods. It will be appreciated that the frame period is short enough so that the information displayed on the liquid crystal display appears with substantially no flicker. FIG. 4 illustrates four alternating current (AC) voltage signals, such as 90, 92, 94 and 96, that are respectively applied to corresponding backplane electrodes within each frame period.

In this particular implementation, the voltage signal level at each segment and backplane electrode varies between four substantially discrete signal levels such as $V_{LCD}$, $\frac{2}{3}V_{LCD}$, $\frac{1}{3}V_{LCD}$, and zero volts. Except at a predetermined time slot within the frame period, each segment and backplane electrode is continually biased at a nominal alternating current (AC) voltage signal level that varies between $\frac{2}{3}V_{LCD}$ and $\frac{1}{3}V_{LCD}$.

The backplane electrodes may be biased in accordance with an arrangement as explained hereinafter. At a predetermined time slot, a corresponding backplane electrode and a segment electrode may be biased at a signal level $V_{LCD}$, or zero, both of which lead to a voltage swing with a magnitude larger than the nominal signal levels. For example, between times $T_0$, and $T_1$, backplane electrode 20 may be biased by voltage signal pulse 74 between voltage signal levels $V_{LCD}$ and zero. Between times $T_1$, and $T_4$, backplane electrode 20 may be biased between voltage signal levels $\frac{2}{3}V_{LCD}$, and $\frac{1}{3}V_{LCD}$. Likewise, backplane electrode 50 may be biased by voltage signal pulse 74 during time $T_1$, and time $T_2$. During other time periods within the frame, backplane electrode 50 is biased between voltage signal levels $\frac{2}{3}V_{LCD}$, and $\frac{1}{3}V_{LCD}$. Similarly, a third backplane electrode (not shown) may be biased by voltage signal pulse 74 during time $T_2$, and time $T_3$. During other time periods within the frame, this backplane electrode is biased between voltage signal levels $\frac{2}{3}V_{LCD}$, and $\frac{1}{3}V_{LCD}$. Finally, backplane electrode 52 is biased by voltage signal pulse 74 during time $T_3$, and time $T_4$. During other time periods within the frame, backplane electrode 52 is biased between voltage signal levels $\frac{2}{3}V_{LCD}$, and $\frac{1}{3}V_{LCD}$.

The segment electrodes may be biased in accordance with an arrangement explained hereinafter. Voltage signal 98 represents an example of voltage signals applied to one of the terminals coupled to one of the seven segment electrodes of numerical digits, such as terminal **34*b* coupled to segment electrode 54 in FIG. 3. As mentioned previously, segment electrodes 54, 56, and 58, in a group of numerical digits, are coupled together. In one example, where a group of four numerical digits are coupled together, it may be desired that the first and last segment electrodes 54 and 58, appear dark and the second and third segment electrodes appear light. Thus, signal 98 applied to terminal 34*b* may be represented by a logical binary number "1001". In this example, logical "1" is a voltage signal having two discrete levels, zero and $V_{LCD}$. Logical "0" is a voltage signal having two discrete levels, $\frac{2}{3}V_{LCD}$ and $\frac{1}{3}V_{LCD}$. Thus, segment electrodes coupled to terminal 34*b* receive voltage signal levels zero and $V_{LCD}$ between times $T_0$ and $T_1$, and times $T_3$ and $T_4$. During times $T_1$ and $T_2$, and times $T_2$ and $T_3$, terminal 34*b*** receives voltage signal levels $\frac{2}{3}V_{LCD}$ and $\frac{1}{3}V_{LCD}$.

The resultant voltage signal across segment electrode 54 coupled to terminal **34*b* and its corresponding backplane electrode is illustrated by voltage signal 102 in FIG. 4. Thus, at time $T_0$, the voltage signal level across segment electrode 54(FIG. 3) and backplane electrode 20 is $V_{LCD}$, which is substantially equal to $V_{LCD}$–zero. A half cycle later, the voltage signal level across segment electrode 54 and backplane electrode 20 is $-V_{LCD}$, which is substantially equal to zero–$V_{LCD}$. The amplitude of voltage signal levels $V_{LCD}$ and $-V_{LCD}$ is large enough to affect the liquid crystals that lie between segment electrode 54 and its corresponding backplane electrode. During the remaining times within the frame period, the voltage signal level across segment electrode 54 and its corresponding backplane electrode 20 swings between $+V_{LCD}/3$ and $-V_{LCD}/3$. These voltage signal levels are not sufficient to affect the liquid crystals that lie between segment electrode 54 and its corresponding backplane electrode 20**. As a result, the orientation of molecules in liquid crystals remain unchanged.

Likewise, the resultant voltage signal across segment electrode 56 and its corresponding backplane electrode 50 is represented by voltage signal 104 in FIG. 4. As mentioned previously, backplane electrode 50 is biased by voltage signal 74 during time $T_1$ to $T_2$ Since it is desired that this segment electrode appear light or transparent, voltage signal 98, which is applied to electrode segment 56, remains at logical "0" during this time. Thus, the amplitude of the resultant voltage signal across segment electrode 56 and its corresponding backplane does not reach a sufficiently high level to change the orientation of molecules in the liquid crystals lying between the electrodes. Voltage signals 94 and 96 represent voltage signal levels of third (not shown) and fourth backplane electrode 52. It will be appreciated that by applying voltage signals in accordance with the arrangement described above, it is possible to maintain a nominal alternating current (AC) voltage signals across the segment and backplane electrodes of a liquid crystal display to substantially prevent the LCD from deteriorating. Whenever it is desired that an electrode segment appears dark, the voltage signal across a segment electrode and its corresponding backplane electrode increases sufficiently to affect the liquid crystals. It will, of course, be appreciated that the appropriate magnitude and polarity of the voltage signal levels applied to segment and backplane electrodes to modify the orientation of the liquid crystal molecules, depend on a number of factors, such as the liquid crystal material employed.

It will also be appreciated that the example of a liquid crystal display with numerical digits as explained in reference with FIGS. 3 and 4 is one of many possible ways that segment electrodes and backplane electrodes may be configured. There are many other applications, where the shape and size of segment and backplane electrodes may vary within the same liquid crystal display. For example, some segment electrodes and their corresponding backplanes may represent alphanumeric characters, others may represent various symbols and characters, and still others may represent bar graphs. Thus, the capacitive load of a segment and its corresponding backplane electrode may vary from a substantially small value to a substantially large value, depending on the particular embodiment. It is desired that the voltage signal level across each capacitive load be switched to a predetermined signal level as illustrated in FIG. 4. Furthermore, it is also desired that the signal overshoot be reduced when the voltage signal level across a capacitive load, switches from one level to another. Otherwise, for example, the information displayed on the liquid crystal display may appear blurred. However, because it is difficult to determine the exact amount of capacitive loading imposed by various segment and backplane electrodes, the design of a voltage signal regulator or driver has disadvantages described with reference to a voltage regulator illustrated in FIG. 5.

Figure 5:
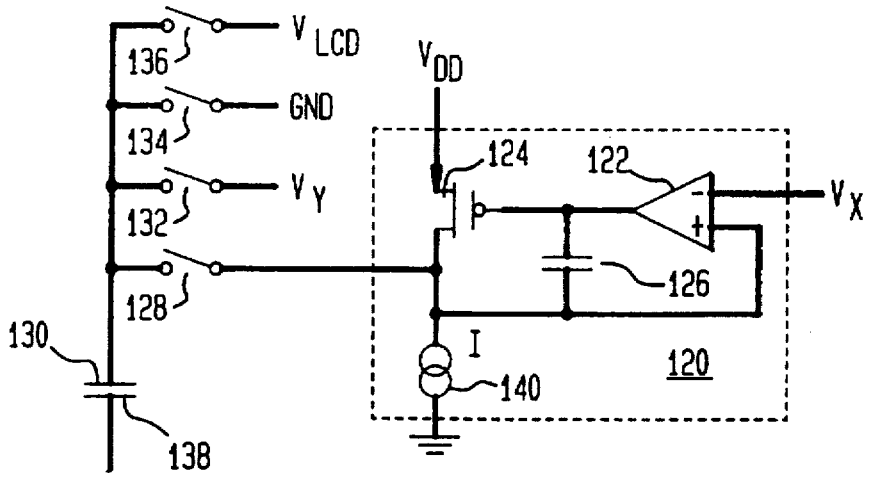
FIG. 5 (PRIOR ART)
FIG. 5 is a high-level schematic of a prior art voltage regulator for driving liquid crystal displays.

FIG. 5 illustrates a prior art embodiment of a voltage regulator 120 that may be utilized to generate voltage signal levels, such as those illustrated in FIG. 4, which may be applied to segment and backplane electrodes of a liquid crystal display. Voltage regulator 120 includes an operational amplifier 122, the inverting input terminal of which is coupled to a reference voltage signal $V_X$. This reference voltage signal may correspond to a voltage signal level, such as $\frac{2}{3}V_{LCD}$ in FIG. 4, for example. The output terminal of operational amplifier 122 is coupled to a p-channel MOSFET transistor 124 that acts as a "pull up" transistor in this configuration. Transistor 124 is coupled to a current source 140. Current source 140 may have one of many possible configurations, such as a MOSFET transistor operating in its saturation region. Transistor 124 and current source 140 are known in the art as a "class A" circuit. The noninverting input terminal of operational amplifier 122 is coupled to the drain of transistor 124 forming a feedback path. The drain of transistor 124 is coupled to a segment electrode 130 via a switch 128. Segment and backplane electrodes are illustrated here as a capacitor due to their capacitive characteristics. Switch 128 may be, for example, a transistor switch, that couples the output terminal of transistor 124 to segment electrode 130. Although not shown, a similar voltage regulator circuit may provide a voltage signal to backplane electrode 138. The voltage signal at the drain of transistor 124 substantially remains at $V_X$, due to the operation of voltage regulator 120.

A voltage regulator similar to voltage regulator 120 may be utilized to provide a reference voltage signal, $V_Y$. Voltage signal, $V_Y$, may correspond to a voltage signal level, such as $\frac{1}{3}V_{LCD}$ in FIG. 4, for example. This voltage signal is coupled to segment electrode 130 via a switch 132. Voltage signals, $V_{LCD}$ and ground, may be coupled to segment electrode 130 via switches 136 and 134, respectively. Voltage signal, $V_{LCD}$, may be generated by a power supply voltage generator that provides power to a liquid crystal display driver.

In this particular embodiment, the same voltage regulator 120 drives all segment electrodes of the liquid crystal display that are desired to be charged at signal level $V_X$ via a plurality of switches, similar to switch 128. Thus, voltage regulator 120 may be driving an unspecified number of capacitive loads at any given time. Because the number of capacitive loads to be charged may vary, it may become difficult to appropriately compensate operational amplifier 122, for this type of operation. This follows, because the load that is driven by the operational amplifier is constantly varying. Each capacitive load may introduce a phase margin at the output signal of the operational amplifier, which is fed back to its input terminal. Therefore, to ensure that the operational amplifier remains substantially stable, it may be desirable to introduce a dominant pole in the feedback loop of the amplifier. The introduction of such a dominant pole allows the phase lag of the output signal of the operational amplifier for all operating frequencies remain within a substantially predetermined level.

The introduction of a dominant pole to reduce the occurrence of instability or oscillation in an operation amplifier is well-known and described in *Analysis and Design of Analog Integrated Circuits*. Gray and Meyer (Wiley, 2d ed. 1984), incorporated herein by reference. One way of introducing a dominant pole is to provide a capacitor 126 coupled between the output terminal of the operational amplifier 122 and the drain of transistor 124. It is desired that this capacitor respond linearly in time, such that voltage signal transitions occurring at the output of operational amplifier do not affect the value of the capacitor. A conventional method to fabricate such a capacitor is based on the use of two layers of polysilicon to form the capacitor. A capacitor formed by this process is also known as a "poly-poly capacitor," which has a substantially linear response. However, particularly for integrated circuits, the manufacture of such poly-poly capacitors adds a degree of complexity to the voltage regulator circuit.

Furthermore, during the operation of the voltage regulator, when switch 128 is closed, current source 140 continually generates a current signal to maintain or regulate the output signal of voltage signal regulator at a voltage signal level, $V_X$. This occurs from the operation of the operational amplifier in combination with the current source to continually adjust the voltage level, at the drain of transistor 124, to signal level, $V_X$. It will be appreciated that voltage regulator 120, as illustrated in FIG. 5, has at least two drawbacks. It employs a current source that continually generates a current, thereby increasing power utilization, and, it employs a poly-poly capacitor, that may introduce fabrication complications.

Figure 1:
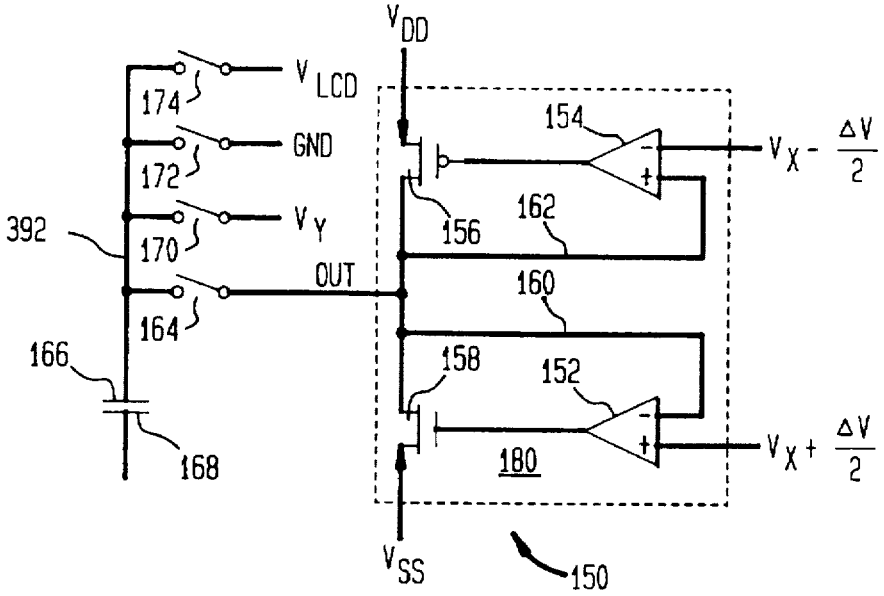
FIG. 1 is a schematic diagram illustrating one embodiment of a liquid crystal display (LCD) driver in accordance with the present invention.

FIG. 1 illustrates one embodiment 150 of a liquid crystal display driver in accordance with the present invention, although the invention is not limited in scope to this embodiment. Embodiment 150 includes voltage signal generators 180 that generate appropriate voltage signal levels for charging segment electrodes and backplane electrodes to a predetermined voltage level. In this particular embodiment, each voltage signal generator includes two operational amplifiers 154 and 152. The inverting input terminal of operational amplifier 154 is coupled to a predetermined reference voltage signal $V_X-\Delta V/2$, and the inverting input terminal of operational amplifier 152 is coupled to a predetermined reference voltage signal $V_X+\Delta V/2$, wherein $\Delta V$ is a substantially small voltage signal value relative to $V_X$. The output terminal of operational amplifier 154 is coupled to a p-channel transistor 156. Likewise, the output terminal of operational amplifier 152 is coupled to a n-channel transistor 158. The source of transistor 156 is coupled to a voltage signal level $V_{DD}$, while the source of transistor 158 is coupled to a voltage signal level $V_{SS}$, which in certain applications may be the ground signal. Therefore, in this embodiment, $V_{DD}$ exceeds $V_{SS}$ in voltage magnitude. The respective drains of transistors 156 and 158 are coupled together and to a segment electrode 166 via a switch 164, which may be typically implemented as a transistor. Transistors 156 and 158 are coupled in the configuration to operate as current sources for providing current to segment electrode 166.

Although the invention is not limited in scope to battery driven liquid crystal displays, in battery driven liquid crystal displays, for example, the power supply voltage signal, $V_{DD}$, may not be used as one of the voltage signal levels applied to segment and backplane electrodes, because the supply voltage signal generated by a battery substantially varies over a period of time. Thus, a voltage signal level $V_{LCD}$, may be generated, for example, by a voltage signal generator, such as one having a configuration like voltage signal generator 180, although the invention is not restricted in scope in this respect. The magnitude of voltage signal level $V_{LCD}$, is the greatest among the voltage signal levels applied to segment and backplane electrodes.

Similarly, voltage signal levels $V_Y$ may be generated by voltage signal generators, such as ones that operate substantially the same as voltage signal generator 180, for example. Accordingly, switch transistor 174 couples voltage signal level, $V_{LCD}$, to segment electrode 166 via a signal line 392, which is also referred to as pad line 392. Likewise, switch transistor 172 couples voltage signal level, ground in this embodiment, to segment electrode 166 via pad line 392. Switch transistor 170 couples voltage signal level, $V_Y$, to segment electrode 166 via pad line 392.

During the operation of liquid crystal display driver 150, switch 164 is closed at a given instant of time so that segment electrode 166 may be charged to a signal level $V_X$. Assume, for example, that when switch 164 is actuated, the voltage signal level at segment electrode 166 has a magnitude that is below $V_X-\Delta V/2$. Because this voltage signal level is now applied to the noninverting input terminal of operational amplifier 154, the output terminal of operational amplifier 154 goes "low." As a result, transistor 156 turns "on" and operates in this configuration as a current source. The capacitance of segment electrode 166 begins charging, and the voltage signal at segment electrode 166 "pulls up" to a voltage signal level substantially equal or slightly exceeding $V_X-\Delta V/2$. Then, the output terminal of operational amplifier 154 goes "high" and transistor 156 turns "off". Meanwhile, since the voltage signal level at segment electrode 166 is still below $V_X+\Delta V/2$, transistor 158 remains turned "off." Thus, the voltage signal level at segment electrode 166 becomes substantially equal to $V_X-\Delta V/2$, and thereafter, both transistors 156 and 158 are turned "off" and no current is drawn from the voltage signal supplies, $V_{DD}$ and $V_{SS}$. The voltage signal generator 180 does not regulate a voltage signal level as previously explained with reference to FIG. 5. When the voltage signal level at segment electrode 166 falls in a desired signal level region, such as substantially equal or slightly exceeding $V_X-\Delta V/2$, and yet below $V_X+\Delta V/2$, no current is drawn from either voltage signal supplies, the voltage signal generator is deactivated and referred to as having entered a "dead zone" region.

Conversely, if at the time when switch 164 is closed, the voltage signal level at segment electrode 166 exceeds $V_X+\Delta V/2$, transistor 158 operates as a current sink and "pulls down" the voltage signal level at segment electrode 166 to a magnitude substantially equal or slightly below $V_X+\Delta V/2$. Once this occurs, transistor 158 turns "off." Meanwhile, because the voltage signal level at segment electrode 166 exceeds $V_X-\Delta/2$, transistor 156 remains mined "off". When the voltage signal level at segment electrode 166 falls in a desired signal level region, such as substantially equal or slightly below $V_X+\Delta V/2$, and yet above $V_X-\Delta V/2$, no current is drawn from either voltage signal supplies, the voltage signal generator is deactivated and enters the "dead zone" region.

Thus, when a segment electrode 166 is coupled to an embodiment of a voltage signal generator for a liquid crystal display driver in accordance with the invention, such as voltage signal generator 180 via switch 164, as illustrated in FIG. 1, the voltage signal generator substantially instantaneously provides a current signal to charge the effective capacitance of the segment electrode to an appropriate voltage signal level. Once the segment electrode is charged to that appropriate voltage signal level, the voltage signal generator enters a dead zone region and discontinues the generation of a current signal. It will be appreciated that the operation of a liquid crystal driver in accordance with the present invention, such as embodiment 150 illustrated in FIG. 1, provides substantial improvement over prior art LCD drivers. For example, one advantage is that an embodiment of a liquid crystal display driver in accordance with the invention may generate a charging current only for a substantially short period of time to charge the effective capacitance of segment and backplanes electrodes, and, therefore, will operate for a substantially longer period of time for a given set of batteries. As an example of another advantage, because less voltage regulation takes place, when the voltage signal generator enters its dead zone region, the likelihood that an oscillation occurs is substantially reduced. As a result, there is less desire for a compensation poly-poly capacitor.

Figure 6:
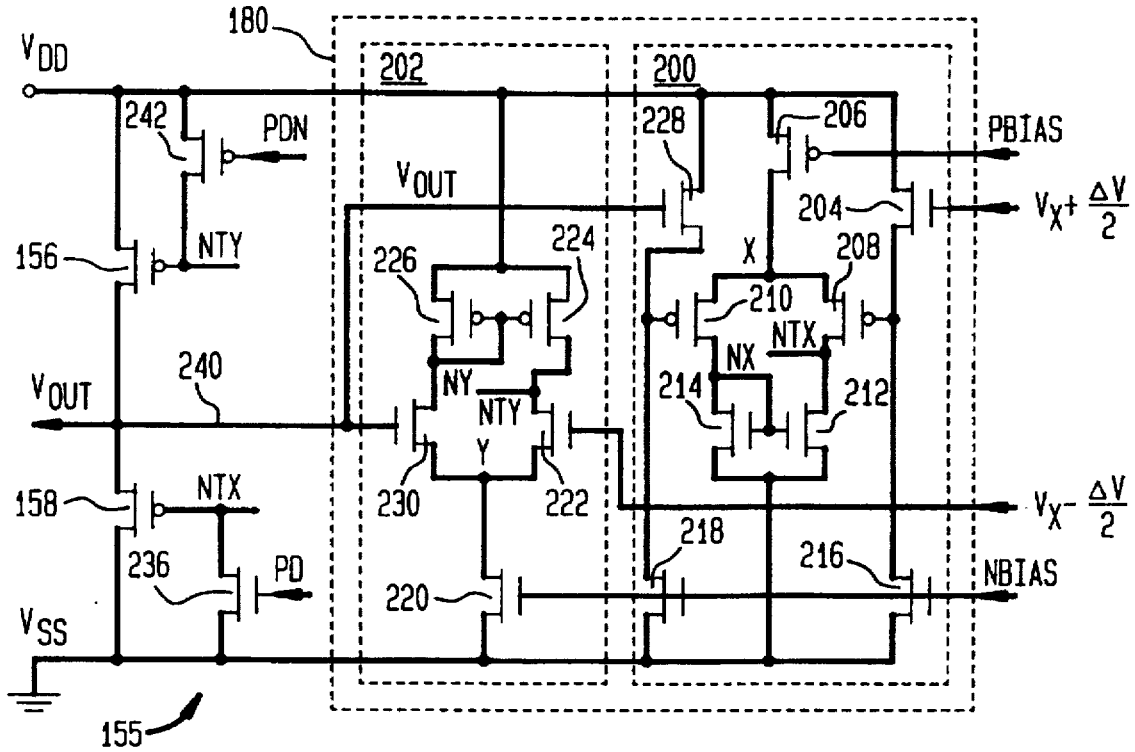
FIG. 6 illustrates a transistor level schematic diagram of an embodiment of a voltage regulator that may be incorporated in a liquid crystal display driver in accordance with the invention.

FIG. 6 illustrates a transistor level diagram of an embodiment 155 of a liquid crystal display driver in accordance with the present invention. It will be appreciated that embodiment 155 may include several signal generators (not shown) that may be configured like voltage signal generator 180 to generate appropriate voltage signals levels for charging segment and backplane electrodes of the liquid crystal display, although the scope of the invention is not restricted in this respect. In the particular embodiment illustrated in FIG. 6, the voltage signal generator is formed by two amplifiers 200 and 202. However, it will be appreciated that the invention is not limited in scope to the configuration illustrated in FIG. 6.

Amplifier 200 is configured as a single stage differential amplifier, although the invention is not limited in scope in this respect and other differential circuits such as an operational amplifier may be employed. Transistors 204 and 228 function as differential input terminals for amplifier 200. The gate of transistor 204 is coupled to a reference voltage signal, $V_X+\Delta V/2$. The sources of transistors 204 and 228 are respectively coupled to a differential input pair comprising transistors 208 and 210. The respective sources of transistors 208 and 210 are coupled together and to a biasing current source transistor 206. The drains of transistors 208 and 210 are coupled to a current mirror circuit arrangement formed by transistors 214 and 212. The gate of transistor 228 serves as the noninverting input terminal of amplifier 200, and is coupled to an output voltage signal line 240. The drain of transistor 228 is coupled to a biasing transistor 218. Likewise, the drain of transistor 204 is coupled to a biasing transistor 216.

Amplifier 202 is also configured as a single stage differential amplifier, although the invention is not limited in scope in this respect and other differential input circuits such as operational amplifiers may be employed. Amplifier 202 includes a differential input pair comprising transistors 222 and 230. The gate of transistor 222 receives a reference voltage signal, $V_X-\Delta V/2$. The gate of transistor 230 is coupled to output voltage signal line 240. The respective sources of transistors 222 and 230 are coupled together and to a biasing current source transistor 220. The drains of transistors 222 and 230 are coupled to a current mirror circuit arrangement formed by transistors 224 and 226.

A current source transistor 158 is coupled to amplifier 200, such that the gate of transistor 158 is coupled to the drain of transistor 208 (terminal NTX), and the source of transistor 158 is coupled to voltage signal supply $V_{SS}$. The drain of transistor 158 is coupled to output signal line 240. Likewise, a current source transistor 156 is coupled to amplifier 202, such that the gate of transistor 156 is coupled to the drain of transistor 224 (terminal NTY), and the source of transistor 156 is coupled to voltage signal supply $V_{DD}$. The drain of transistor 156 is coupled to output signal line 240. Finally, transistors 242 and 236 operate as power down transistors and are activated whenever it is desired to shut down the operation of the voltage signal generator.

During operation, when it is desired to charge one or more segment or backplane electrodes to a voltage signal level $V_X$, output voltage signal line 240 is coupled to the appropriate segment or backplane electrodes via switch 164, as illustrated in FIG. 1. If, for example, the voltage signal level of a segment or backplane electrode is below voltage signal level $V_X-\Delta V/2$, the voltage signal generator becomes activated. Thus, amplifier 202 begins driving transistor 156 so as to pull up the voltage signal level of the electrode to the desired voltage signal level. A current signal begins flowing through transistor 156 to charge the appropriate segment or backplane electrode. The voltage signal at the drain of transistor 156 begins rising toward $V_{DD}$. However, when this voltage signal becomes substantially equal or slightly exceeds $V_X-\Delta V/2$, the voltage signal generator becomes deactivated. Thus, amplifier 202 stops driving transistor 156. Transistor 156 turns "off" and the current signal stops flowing through the transistor. The voltage signal level at the drain of transistor 156 and at the appropriate segment or backplane electrode remain at a voltage signal level substantially equal to $V_X-\Delta V/2$. Meanwhile, transistor 158 is turned "off" when the voltage signal level at the appropriate segment or backplane electrode reaches its desired voltage signal level. Therefore, once the appropriate segment or backplane electrode is charged to its desired voltage signal level, voltage signal generator becomes deactivated and effectively enters its dead zone for the remaining period that is desired to maintain the desired voltage signal level at the appropriate segment or backplane electrode. Conversely, when the appropriate segment or backplane electrode is at a voltage signal level exceeding $V_X+\Delta/2$, the voltage signal generator is activated. Amplifier 200 drives transistor 158 to pull down the voltage signal level at the electrode to the desired voltage signal in a manner explained above.

Figure 7:
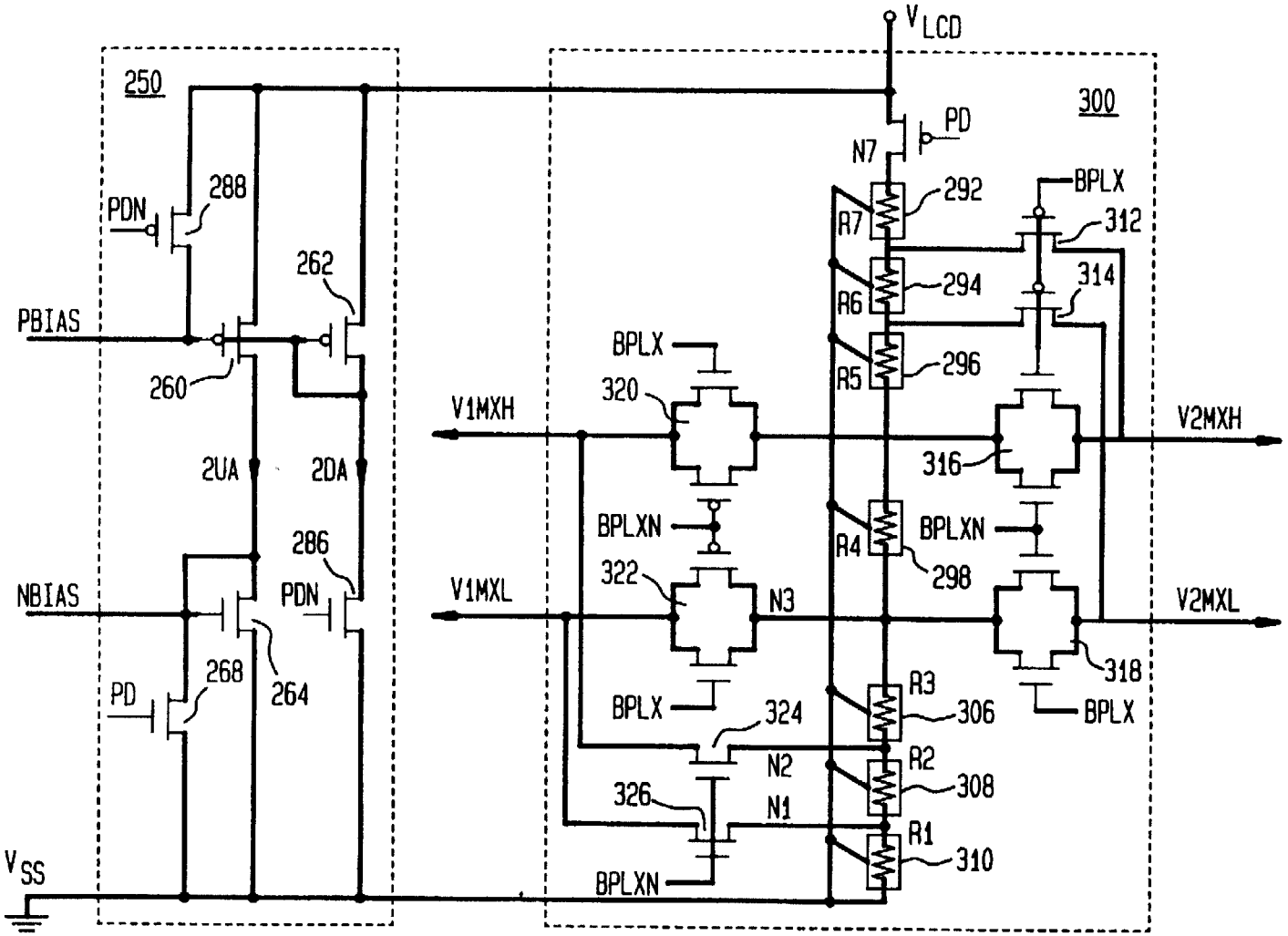
FIG. 7 illustrates a transistor level schematic diagram of an embodiment of a biasing circuit that may provide biasing signals to the transistors illustrated in FIG. 6.

FIG. 7 illustrates a transistor schematic diagram of embodiments 250 and 300, respectively of a biasing signal generator and a reference voltage signal generator, such as may be employed in a liquid crystal driver in accordance with the present invention. However, the invention is not limited in scope to this configuration for generating biasing and voltage signals, and other well-known methods may be utilized.

Embodiment 250 of the biasing signal generator includes current mirrors formed by transistors 260 and 262. Transistor 288 forms a current mirror with transistors 286. Transistor 264 forms a current mirror with transistors 220, 218 and 216 (FIG. 6). Transistor 286 is biased so as to be in its linear region of operation and operates as a resistor. A signal level PDN may be applied to the gate of transistors 286 and 288 to turn them "off." Likewise, a signal level PD may be applied to the gates of transistor 268 to turn it "off." By applying these PDN and PD signals, the biasing circuit may be powered down, whenever desired.

Embodiment 300 of the reference voltage signal generator is formed by voltage divider resistors 292, 294,296,298,306, 308 and 310 coupled together in series. In this particular embodiment, reference voltage signal generator is powered by a power supply voltage signal level, $V_{LCD}$. The voltage signal across resistor 292 is applied to V2MXH terminal via a switch transistor 312. The voltage signal across resistor 292 is applied to V2MXL terminal via a switch transistor 314. The voltage signal level at terminal V2MXH is substantially equal to $\frac{2}{3}V_{LCD}+\Delta V/2$, where $V_{LCD}$ is the magnitude of voltage supply signal applied to reference voltage signal generator 300. The voltage signal level at terminal V2MXL is below the voltage signal level at terminal V2MXH, and is substantially equal to $\frac{2}{3}V_{LCD}-\Delta V/2$. It will be appreciated that voltage signal levels at terminals V2MXH and V2MXL correspond to reference voltage signal levels, such as, for example, $V_X+\Delta V/2$ and $V_X-\Delta V/2$ with reference to FIGS. 1 and 6. Likewise, the voltage signal across resistor 308 is applied to V1MXH terminal via a switch transistor 324, and the voltage signal across resistor 310 is applied to V1MXL terminal via a switch transistor 326. The voltage signal level at terminal V1MXH is substantially equal to $\frac{1}{3}V_{LCD}+\Delta V/2$. The voltage signal level at terminal V1MXL is below the voltage signal level at terminal V1MXH and is substantially equal to $\frac{2}{3}V_{LCD}-\Delta V/2$. It will be appreciated that voltage signal levels at terminals V1MXH and V1MXL correspond to a second set of reference voltage signal levels, for example, $V_Y+\Delta V/2$ and $V_Y-\Delta V/2$ (not shown).

Reference voltage signal generator 300, in this particular embodiment, may generate either two voltage signal levels substantially equal to $\frac{1}{3}V_{LCD}$, and $\frac{2}{3}V_{LCD}$, or one voltage signal level substantially equal to $\frac{1}{2}V_{LCD}$. This is useful because in certain liquid crystal display applications it may be desired to have three signal levels, for example, $V_{LCD}$, $\frac{1}{2}V_{LCD}$, and $V_{SS}$ or ground. In certain other liquid crystal display applications it may be desired to have four signal levels, for example, $V_{LCD}$, $\frac{2}{3}V_{LCD}$, $\frac{1}{3}V_{LCD}$ and $V_{SS}$ or ground. When it is desired to have three signal levels, transmission gates or pass gates 316, 318, and pass gates 320 and 322, couple the voltage signal across resistors 296 and 298 to output terminals of reference voltage signal generator 300. The voltage across resistor 296 is substantially equal to $\frac{1}{2}V_{LCD}+\Delta V/2$, whereas the voltage across resistor 298 is substantially equal to $\frac{1}{2}V_{LCD}-\Delta V/2$. Pass gates 316, 318, 320 and 322 are actuated by a voltage signal level applied to terminals BPLX and BPLXN. The voltage signal level turns "off" transistors 312, 314, 324 and 326. The operation of pass gates or transmission gates are well-known and described in *Principles of CMOS VLSI Design*, Weste, Eghraghian (Addison-Wesley 1993), incorporated herein by reference. Basically, each transmission gate comprises a p-channel and an n-channel transistor. The respective source and drains of the two transistors are coupled together. When the respective gates of the two transistors receive a complementary signal, the voltage signal at the respective sources becomes substantially equal to the voltage signal at the respective drains of the transistors.

Figure 8:
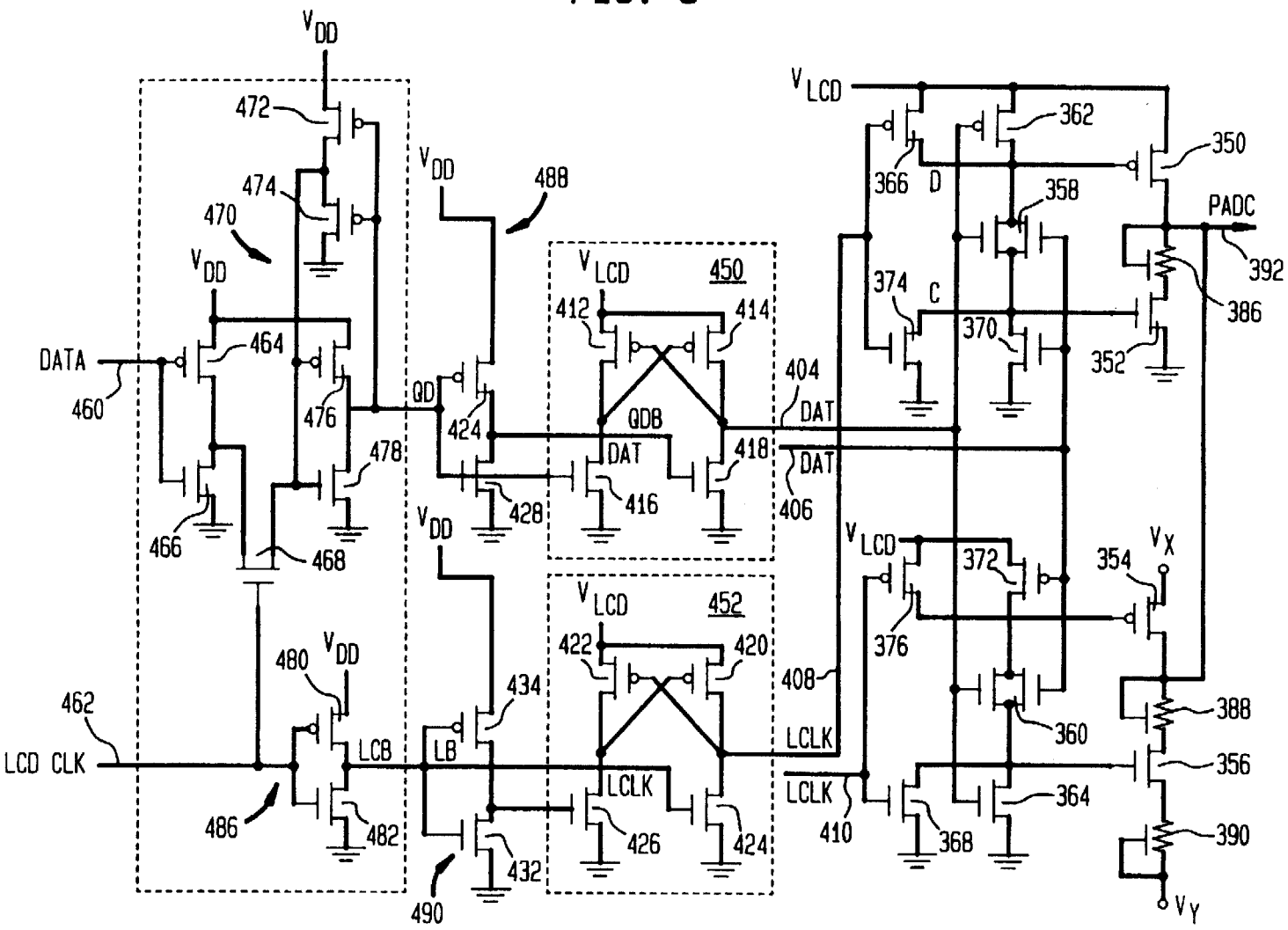
FIG. 8 illustrates a transistor level schematic diagram of an embodiment of a switching controller that may be employed to provide voltage signals to segment and backplane electrodes of a liquid crystal display. Such an embodiment of a switching controller may be incorporated in an embodiment of a liquid crystal display driver in accordance with the invention.

FIG. 8 illustrates a transistor level schematic diagram of an embodiment of a switching controller that applies appropriate voltage signals to segment and backplane electrodes of a liquid crystal display. Such a switching controller may be used in conjunction with a liquid crystal display driver in accordance with the present invention, although the scope of the invention is not limited in this respect. Thus, voltage signal level $V_{LCD}$, is applied to pad line 392, also illustrated in FIG. 1, via transistor 350. The ground voltage signal is applied to pad line 392 via transistor 352. Likewise, voltage signal level $V_X$ is applied to pad line 392 via transistor 354, and voltage signal level $V_Y$ is applied to pad line 392 via transistor 356. Devices 386, 388 and 390 provide electrostatic discharge protection. The gate of transistor 350 is coupled to the drain of transistor 366 and to respective source of transistors forming transmission gate 358. Transistor 362 applies voltage signal $V_{LCD}$ to the gate of transistor 350, when transistor 362 is turned "on" by a low voltage signal applied to its gate. Likewise, transistor 370 applies ground voltage signal to the gate of transistor 352, when transistor 370 is turned "on" by a high voltage signal ($V_{LCD}$) applied to its gate. The gate of transistor 354 is coupled to the drain of transistor 376, and to respective sources of the transistors forming transmission gate 360. Transistor 372 applies voltage signal $V_{LCD}$ to the gate of transistor 354, when transistor 372 is turned "on" by a low voltage signal applied to its gate. Transistor 364 applies ground voltage signal to the gate of transistor 356, when transistor 364 is turned "on" by a high voltage signal applied to its gate.

The operation of pass or transmission gates 358 and 360, in this particular embodiment, is controlled by complementary voltage signals, DAT and DAT_ applied via data lines 404 and 406, respectively. Thus, when voltage signal DAT is high and voltage signal DAT_ is low, transistors 372 and 364 turn "on", and in response, transistors 354 and 356 cannot be turned "on". However, pass transistor 358 couples the drain of transistor 366 to the drain of transistor 374, and depending on the voltage signal level LCLK on line 408, one of transistors 350 or 352 may be tamed "on." Conversely, when voltage signal DAT is low and voltage signal DAT_is high, transistors 362 and 370 turn "on," and in response transistors 350 and 352 cannot be turned "on." However, pass transistor or transmission gate 360 couples the drain of transistor 376 to the drain of transistor 368, and, depending on the voltage signal level LCLK_on line 410, one of transistors 354 and 356 may be tamed "on".

The voltage signal levels on lines 408 and 410 are also complementary. When the voltage signal level on line 408 is "high," and the voltage signal level on line 410 is "low," depending on the state of voltage signals DAT and DAT_, either one of transistors 350 or 356 turn "on.". Conversely, when the voltage signal level on line 408 is "low," and the voltage signal level on line 410 is "high," depending on the state of voltage signals DAT and DAT_, either one of transistors 352 or 354 turn "on." Thus, voltage signals DAT and LCLK in combination provide control signals for actuating one of the switches 350, 352, 354 or 356.

The control signals DAT and LCLK for actuating one of the switches mentioned above, are generated by a an integrated circuit or chipset (not shown) configured to generate the data signals corresponding to the information that is desired to be displayed on the liquid crystal display. Such a chipset may generate control DAT and LCLK signals that comprise logical "1s" and "0s", where logical 1 corresponds to voltage signal level $V_{DD}$, and logical "0" corresponds to a ground voltage signal. However, because the liquid crystal display electrodes may be powered by a voltage signal level $V_{LCD}$, it is necessary to shift the control signal levels from $V_{DD}$ to $V_{LCD}$. This task is accomplished by level shifters 450 and 452. The operation of level shifter 450 is substantially the same as that of 452. Level shifter 450 comprises transistors 412, 414, 416 and 418, for control voltage signal DAT. Level shifter 452 comprises transistors 420, 422, 424, 426, for control voltage signal LCLK. Accordingly, the gate of transistor 414 is coupled to the respective drains of transistors 412 and 416, and the gate of transistor 412 is coupled to respective drains of transistors 414 and 418. The gate of transistor 416 receives a control voltage signal QD that corresponds to voltage signal DAT. The gate of transistor 418 receives a voltage signal QDB that corresponds to voltage signal DAT_. The drain of transistor 414 generates the voltage signal DAT at voltage signal line 404. Likewise, the drain of transistor 412 generates the voltage signal DAT_at voltage signal line 406.

The control voltage signals that eventually translate to voltage signals DAT and LCLK are provided by a controller (not shown) coupled to DATA line 460 and a clock LCDCLK line 462. Typically the controller may be a display read and write memory (RAM), that provides the appropriate signals for actuating one of the switches that apply a voltage signal level to pad line 392. Transistors 464 and 466 form an inverter that receives the incoming signal on DATA line 460. The output signal of the inverter is coupled to a switch transistor 468. When the voltage signal at LCDCLK line 462 is "high", transistor switch 468 actuates and passes the output signal of the inverter to a latch 470 comprising transistors 472, 474, 476 and 478. Latch 470 holds the incoming signal on DATA line 460 from one clock pulse at LCDCLK line 462 to a successive clock pulse provided at LCDCLK line 462. Likewise, an inverter 486 formed by transistors 480 and 482 receives the signal present at LCDCLK line 462. The output port of flip-flop 470 is coupled to an inverter 488 formed by transistors 424 and 428. Likewise, the output signal generated by inverter 486 is applied to another inverter 490, formed by transistors 432 and 434, and operates substantially the same as inverter 488.

Thus, an embodiment of a liquid crystal display driver in accordance with the present invention addresses problems associated with prior art drivers, such as unstable operation of voltage regulators, relatively complex manufacturing process to provide a poly-poly capacitor, or power drainage. The embodiment of a liquid crystal display driver in accordance with the present invention, for example, may provide a plurality of voltage signals for driving segment and backplane electrodes, in a conveniently configured arrangement, and use less power than conventional drivers.

While only certain features of the invention have been illustrated and described herein, many modifications, substitutions, changes or equivalents will now occur to those skilled in the art. It is therefore, to be understood that the appended claims are intended to cover all such modifications and changes that fall within the true spirit of the invention.

We claim:

1. A liquid crystal display driver for driving liquid crystal display electrodes, comprising:

a voltage signal generator adapted to provide a predetermined voltage signal to said liquid crystal display electrodes, said voltage signal generator being further adapted to be activated when the voltage signal level of said electrodes is outside a predetermined dead zone region, said voltage signal generator being deactivated when the voltage signal level of said electrodes is substantially within said predetermined dead zone region such that said voltage signal generator substantially discontinues the generation of said predetermined voltage signal; and a switch adapted to couple said voltage signal generator to at least one of said liquid crystal display electrodes.

2. A liquid crystal display driver according to claim 1, wherein said dead zone region comprises voltage signal levels between a first and a second predetermined reference voltage signal levels, wherein said second predetermined reference voltage signal level is larger than said first predetermined reference voltage signal level.

3. A liquid crystal display driver according to claim 2, wherein said switch is adapted to couple said voltage signal generator to more than at least one of said liquid crystal display electrodes, said voltage signal generator further comprising a first and a second current source, said first current source being coupled in said generator so as to provide a charging current flow to a switch-coupled display electrode having a voltage signal level below said first predetermined reference voltage signal, said second current source being coupled in said generator so as from provide a discharging current flow to a switch-coupled display electrode having a voltage signal level exceeding said second predetermined reference voltage signal.

4. A liquid crystal display driver according to claim 3, wherein said signal generator comprises a first and a second operational amplifier, said first current source being adapted to be driven by said first operational amplifier, and said second current source being adapted to be driven by a second operational amplifier.

5. A liquid crystal display driver according to clam 4, wherein said first current source comprises a first transistor coupled so as to operate in a saturation region, and said second current source comprises a second transistor coupled so as to operate in a saturation region.

6. A liquid crystal display driver according to claim 5, wherein the output terminal of said first operational amplifier is coupled to the gate of said first transistor, the noninverting input terminal of said first operational amplifier being coupled to the drain of said first transistor and the inverting input terminal of said operational amplifier being coupled so as to receive said first predetermined reference voltage signal.

7. A liquid crystal display driver according to claim 6, wherein the output terminal of said second operational amplifier is coupled to the gate of said second transistor, the noninverting input terminal of said second operational amplifier being coupled to the drain of said second transistor and the inverting input terminal of said operational amplifier being coupled so as to receive said second predetermined reference voltage signal.

8. In a liquid crystal display driver for providing voltage signals to liquid crystal display electrodes, a voltage signal generator comprising:

a first differential amplifier including a first and second input terminals and an output terminal, said first input terminal of said first differential amplifier being coupled so as to receive a first predetermined reference voltage signal;

a second differential amplifier including a first and second input terminals and an output terminal, said first input terminal of said second differential amplifier coupled so as to receive a second predetermined reference voltage signal;

a first current source coupled to said output terminal of said first differential amplifier, said first current source being adapted to be coupled to said electrodes via a coupling switch, the output terminal of said current source being coupled to said second terminal of said first differential amplifier;

a second current source coupled to said output terminal of said second differential amplifier, said second current source being adapted to be coupled to said electrodes via said coupling switch, the output terminal of said second current source being coupled to said second terminal of said second differential amplifier; and said first current source being adapted to provide a charging current signal to said electrodes when the voltage signal level of said electrodes falls outside a predetermined dead zone region, said first current source being adapted to cease said charging current signal when the voltage signal level of said electrodes falls within said predetermined dead zone region, said second current source being adapted to provide a discharging current signal from said electrodes when the voltage signal level of said electrodes falls outside said predetermined dead zone region, said second current source being adapted to cease said discharging current signal when the voltage signal level of said electrodes fall within said predetermined dead zone region.

9. A liquid crystal display driver according to claim 8 wherein said dead zone region comprises voltage signal levels between a first and a second predetermined reference voltage signal level.

10. A liquid crystal display driver according to claim 9, wherein said first and second differential amplifiers each comprise transistors forming a differential input pair.

11. A liquid crystal display driver according to claim 10, wherein said first and second current source each comprise at least one transistor coupled so as to operate in its saturation region during liquid crystal driver operation.

12. A liquid crystal display driver according to claim 9, wherein said coupling switch comprises a transistor adapted to be actuated by a control signal.

13. A liquid crystal display driver according to claim 10 further comprising at least one other voltage signal generator, wherein said electrodes are selectively coupled, by a switching controller to said voltage signal generators, each providing a predetermined voltage signal to said electrodes.

14. A liquid crystal display driver according to claim 13, further comprising a voltage divider adapted to provide said predetermined reference voltage signals.

15. A liquid crystal display driver according to claim 14 further comprising a signal level shifter coupled to said coupling switches, to shift voltage signal level, $V_{DD}$, generated by a direct current (DC) power supply to a predetermined voltage signal level, $V_{LCD}$, such that said voltage divider is adapted to generate said predetermined reference voltage signals having magnitudes substantially equal to a fraction of said voltage signal level, $V_{LCD}$.

16. A method for providing voltage signals to electrodes of a liquid crystal display comprising the steps of:

activating a first voltage signal generator to provide a predetermined voltage signal for said electrodes when the voltage signal level of said electrodes falls outside a dead zone region; and deactivating said first voltage signal generator when the voltage signal level of said electrodes falls within said dead zone region, such that said voltage signal generator substantially discontinues the generation of said predetermined voltage signal.

17. The method for providing voltage signals according to claim 16, wherein said dead zone region comprises voltage signal levels between a predetermined first and a second reference voltage signal level.

18. The method for providing voltage signals according to claim 17, wherein said step of activating said first voltage signal generator comprises the steps of:

comparing the voltage signal level of an electrode with said first and second predetermined reference voltage signals; and activating a current source when said voltage signal level of said electrode falls outside said dead zone region.

19. The method for providing voltage signals according to claim 17, further comprising the steps of activating and deactivating voltage signal generators other than said first voltage signal generator, said voltage signal generators being adapted to provide a predetermined voltage signal to said electrodes.

20. The method for providing voltage signals according to claim 19, wherein for each group of said electrodes the method further comprises the step of selectively coupling a voltage signal generator to said group of electrodes to provide a predetermined voltage signal to the electrodes in said group.

21. A method for providing voltage signals to electrodes of a liquid crystal display comprising the steps of:

comparing the voltage signal level of an electrode with a first and a second predetermined reference voltage signal level which define a dead zone region, wherein said step of comparing is accomplished by a first and second differential amplifier adapted to receive said respective first and second predetermined reference voltage signals;

activating a current source when said voltage signal level of said electrode falls outside said dead zone region; and deactivating said current source when said voltage signal level of said electrode falls outside said dead zone region.

* * * * *

UNITED STATES PATENT AND TRADEMARK OFFICE

CERTIFICATE OF CORRECTION

PATENT NO. : 5,675,352
DATED : October 7, 1997
INVENTOR(S) : David Arthur Rich and Harold Joseph Wilson It is certified that error appears in the above-identified patent and that said Letters Patent is hereby corrected as shown below:

Column 14,
Line 29, replace “from” with -- to --.
Line 30, replace “to” with -- from --.

Signed and Sealed this

Eighteenth Day of May, 2004

JON W. DUDAS
*Acting Director of the United States Patent and Trademark Office*